United States Patent [19]

Fisch et al.

[11] 3,938,997

[45] Feb. 17, 1976

[54] RAPID ACCESS, AIR STABLE, REGENERABLE IRON CHELATE DEVELOPER SOLUTIONS

[75] Inventors: Richard S. Fisch; Norman Newman, both of St. Paul, Minn.

[73] Assignee: Minnesota Mining and Manufacturing Company, St. Paul, Minn.

[22] Filed: Mar. 28, 1975

[21] Appl. No.: 563,064

[52] U.S. Cl. ..... 96/66.3; 96/48 R; 96/50 R; 96/66 R; 96/66 HD

[51] Int. Cl.[2] ..... G03C 5/30; G03C 5/26

[58] Field of Search ..... 96/66.3, 66 R, 50 R, 48 R, 96/66 HD

[56] References Cited

UNITED STATES PATENTS

| | | | |
|---|---|---|---|
| 2,688,549 | 9/1954 | James | 96/66 HD |
| 3,567,441 | 3/1971 | Vogt | 96/66 R |
| 3,723,126 | 3/1973 | Price | 96/48 R |

*Primary Examiner*—Mary F. Kelley

*Attorney, Agent, or Firm*—Alexander, Sell, Steldt & DeLaHunt

[57] ABSTRACT

Rapid access, air stable, regenerable iron chelate developers comprising at least three developer materials, at least one selected from each of the groups comprising:

1. iron chelate developers
2. an ascorbic acid and
3. phenidone, glycin, cysteine hydrochloride, hydroxylamine sulfate, hydroquinone monosulfonate and 4-amino-N-ethyl-N-($\beta$-methanesulfoneamidoethyl)-m-toludine.

5 Claims, No Drawings

RAPID ACCESS, AIR STABLE, REGENERABLE IRON CHELATE DEVELOPER SOLUTIONS

This invention relates to photographic science and in particular to silver halide photographic emulsion development.

Exposure of a silver halide emulsion to radiation to which the emulsion has been sensitized produces a latent image in the silver halide grains of the emulsion. The image is latent because the grains are sensitized to reduction by the formation of minute quantities of free silver in the grains from the exposure. The grains are developed usually by immersion of the exposed photosensitive material in an aqueous reducing solution. The reducing agents conventionally employed include such organic materials as hydroquinone and other materials meeting the criteria of Kendall's Rule or the extension of this rule by Peltz [Mason, Photographic Chemistry, pp. 16–29, Focal Press, 1966, London].

Historically, the organic reducing agents presently in commercial use were preceded by the use of inorganic metal salt solutions as developers. Ferrous sulfate solutions were among the first used, these being followed by complexed ferrous ion solutions such as ferrous oxalate. Although the complexed ion solutions offered tremendous developing advantages over the simple salt solutions, they nonetheless still suffered from exhaustion because of the antagonistic effect of the presence of the oxidized form of the metal ion (e.g., ferric). Because the reduction of the silver with the consequent oxidation of the metal ion is an equilibrium reaction, the presence of ferric ions greatly reduces the thermodynamic driving force for the reaction. The improvement offered by the complexing species was in the suppresion of the oxidized form of the metal ion by formation of the complex. The failure of these complexed type developers, even with the introduction of the superior complexing agents, due to oxidized ion, is generally unavoidable since these oxidized ions may be formed by development or aerial oxidation. In fact, in order to obtain consistent results with such developers, development has been performed under a nitrogen atmosphere so as to exclude oxygen (U.S. Pat. No. 2,453,323). Other techniques have been attempted to obtain consistent results in these metal salt solutions, such as the inclusion of metal powders or granules in the development solution itself, trying to maintain the dissolved metal ions in their lower valence state. Amman-Brass, Beitrag Zur Chemie dir Anorganischen Entwickler, Photo. Ind. 1937, p. 827. These developers have not found favor in the photographic field because the developing solutions are, at their best, still slow acting, requiring at least about 20 minutes for completion of development and sometimes hours. The solutions also tend to produce low contrast images and do not correct for other changes in the composition of the bath due to the development process.

Recent work has been directed towards obtaining more active rapid acting developers. S. Mizusawa - Chiba Daiga Ku Kobabubu Kentyu Hokoku (Research Reports Chiba U. Facility of Engineering), Vol. 19 No. 35 pp. 77–84, March 61 discloses a monobath developer based on the use of ferrous EDTA (ethylenediaminetetraacetic acid) and hypo (Na or $NH_4$ thiosulfate). Although Mizusawa shows the superadditivity of development of the addition of phenidone to this system he nevertheless requires a pH of 11.0 with a development time of 8 minutes or more at 20°C. to obtain average contrasts in the order of 1.0.

Vogt, U.S. Pat. No. 3,567,441 discloses that these developers are suitable for rapid access development at temperatures ranging from 65°F. to 212°F. in a pH range of 4 – 6.9 with development times in the order of 3 minutes. In order to obtain these short processing times of 3 minutes or less, this patent states that a hardening agent for the gelatin must be included in this developer. The inclusion of aldehydes in metal complex developers has previously been reported in British Pat. No. 741, 1889.

It is believed that the Vogt process must operate under a non-oxidizing atmosphere (e.g., nitrogen) in order to operate consistently. In view of this requirement the practical application of these developers has been reported (G. Haist et al., Photo. Engineering, Vol. 7, 182–189, 1956) as still limited.

It is therefore the object of this patent to disclose developers based on the use of metal complexes that have improved stability to air, rapid access capability and produce images of high contrast.

It has been found that certain at least ternary systems can provide air stability, rapid access capability, and reasonably high contrast images. These at least ternary systems comprise a first group comprising at least one metal organic chelating developer, a second group comprising an ascorbic acid (including its stereoisomers, diastereoisomers, and sugar type derivatives), and a third group comprising certain other select uncomplexed developers for exposed silver halide crystals (phenidone, hydroxylamine sulfate, hydroquinone monosulfonate, glycin, cysteine hydrochloride, and 4-amino-N-ethyl-N-($\beta$-methane sulfoneamidoethyl)-m-toluidine).

The ascorbic acid compounds contemplated in the practice of this invention include ascorbic acid and the sugar-type derivatives of ascorbic acid, and the stereoisomers and diastereoisomers of those acids. The ascorbic acids, including the sugar-type derivatives of ascorbic acid as well as ascorbic acid, may be represented by the generic structural formula:

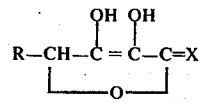

wherein X is an oxygen atom or imino group, R is any group which does not render the ascorbic acids water insoluble and is a non-interfering group. Non-interference means that the R group does not cause stearic hindrance, is not chemically reactive with other portions of the molecule, is not a coordinating group for the molecule and is not more electropositive than a saturated hydrocarbon residue.

Preferably R is an aryl group or a group of the formula $R^1CH_2(CHOH)_{n-1}-$ wherein n is a positive integer from 1 to 4 and $R^1$ is either a hydrogen atom or hydroxyl group when $n$ is 2 to 4 and is an hydroxyl group when $n$ is 1.

Of these materials ascorbic acid and isoascorbic acid are the most preferred materials. R may be any non-interfering organic group which does not render the ascorbic acid type material water insoluble, as R is not the developmentally active portion of the compound.

The concentrations of these individual developing agents may vary according to individual requirements but the general ranges for use as a developer are about as follows:

Metal Chelate Developer
Metal concentration: 0.05M to 1.0M
Chelate agent minimum = metal ion concentration
maximum = 3 times the concentration of metal ions
Ascorbic Acid Group of Developers
0.05M to solubility limit
Third Developer Group: 0.1mM to 100mM The concentration of the ascorbic acid group of developers should always be greater than the concentration of the third developer group which should have a concentration of at least 0.1 mM.

It has been found that the addition of ascorbic acids, its stereoisomers, or diastereoisomers and derivatives of these acids to such metal chelate developers along with the third class of developers in an at least ternary system yields developers which have increased stability to air oxidation and surprisingly give high contrast images and do so in developer processing times of less than 2 minutes (typically ¼ to 1 minute). Although the superadditivity of phenidone and a metal chelate developer has been reported and the superadditivity of phenidone and ascorbic acid has been reported, U.S. Pat. No. 2,688,549, we have now surprisingly found that the combination of the 3 components provides greater enhancement than one would predict from addition of the individual contributions, and more importantly enables the formation of air stable high contrast imaging with rapid access capability. The superadditivity effect has also been found for the following materials as equivalents of phenidone in this ternary system: hydroxylamine sulfate, glycin, cysteine hydrochloride and 4-amino-N-ethyl-N-(β-methanesulfoneamidoethyl)-m-toluidine.

The practice of this invention generally relates to air stable, rapid access and regenerable describe substantive properties of the developer solutions.

The term metal chelate developing agent as used in the practice of this invention refers to iron associated with a chelating agent, sequestering agent or complexing agent (for the practice of this invention, these are alternative terms). The metal portion of the metal chelate is required to have at least two distinct valence states (i.e., $Fe^{+2}$ and $Fe^{+3}$ for iron).

The lower valent ion is the developing agent (reducing agent) which usually functions by simple electron transfer to the silver ion; the higher valent metal ion is formed as a result. The presence of these latter oxidized ions (higher valent ions) provides an antagonistic effect toward the further reduction of silver halide by the lower valent ion, and small buildup of such higher valent ions by either the result of development or aerial oxidation is sufficient to seriously hamper the development reaction.

The chelate portion of the metal chelate are those chelate, sequestering or complexing materials whose stability constant for the higher valence state of a metal is higher than that for the lower valence state. These stability constants may be found for example in reference books (e.g., *Stability Constants of Metal-Ion Complexes*, Chemical Society, London, 1964). In the most preferred embodiments, the ratio of the stability constants of the higher state to the lower state should be at least 100:1 respectively. The most preferred chelating agents in the practice of this invention are ethylenediaminetetraacetic acid and diethylenetriaminepentaacetic acid (EDTA and DTPA respectively).

For a particular metal ion developer, satisfactory complexing agents are those which form a more stable complex with the higher valent ion that the lower valent ion (Mason, *Photographic Chemistry*, Focal Press, 1966, p. 173) thus effectively reducing the concentration of the antagonist higher valent ion. The fact is, nevertheless, that the buildup of the higher valent ion, either by the development reaction or aerial oxidation, proceeds and even in the presence of these complexing agents, the baths eventually deteriorate and become unuseable (C. E. Mees, 2nd Ed., McMillan, 1942, p. 332). The addition of various additives such as formaldehyde (Brit. Pat. 741; 1889), though successful in hardening the emulsion, provide no improvement in aerial stability.

Rzymkowski in 1941 (Rzymkowski, Wiss. Photo. 40 136 (1941)) categorized the metal complex developers as having the following structure:

$$(Alk^{+1})_n\,[(RCOO^-)_y M_m^{+z}]$$

in which Alk is an alkali metal, M is the metal ion of a multiple valent metal and R is an organic radical and $y = mz + n$. These materials are included within the present disclosure of metal chelates.

The earliest successful use of iron, i.e., ferrous ion, in a developer was by Carey Lea (B. J. Phot. 24, 292 (1877)). Lea utilized a "complexing agent," potassium oxalate, in his developer.

In 1951 Rausch and Russel introduced developers using a different class of complexing agents which showed much greater superiority in their affinity to complex the higher valent metal species and so exhibited some improved performance of the developers. These materials were aliphatic amino-polycarboxylic acids and their water soluble salts (Br. Pat. 720,235) commonly known at the times as "chelating" or "sequestering" agents which have given rise to the term "metal chelate developers." Rzymkowski in 1951 (Pharmazie (1951) 6, p. 155–6) noted that these developers fitted his definition and equated the terminology of "metal complex" and "metal chelate" developers (Industrie Chim. Belg. Spec. No. 645–6 (1955)). This terminology based on this narrowed definition for the word "complex" persists to the present, and in fact there are few metal complex developers which are based on a complexing agent rather than a chelating agent of one sort or another.

The practice of this invention generally relates to air stable, rapid access and regenerable describe substantive properties of the developer solutions.

Air stable metal chelate developer solutions are those which do not undergo a change of greater than 50 millivolts in its redox potential during two days exposure. In the use of these metal chelate developers, such air stability enables the maintenance of a desired level of developmental activity without requiring the gross addition of replacement chemistry.

The solutions of this developing system are rapid access developers. This means that the dwell time in the developer need be only 4 minutes or less for producing a useful image having 90 percent of the useful Dmax produced by that developer in 8 minutes with the same exposure and handling of the photographic element. The useful Dmax may, of course, depend upon the particular application of the photographic element, but must be viewable over fog levels of the elements. It is preferred that the dwell time need be only 2 minutes for 90 percent of the useful Dmax of 4 minutes dwell time in the same developer.

The solutions are also regenerable. This means that the solution, after or during use may be maintained at the same level of electromotive potential without the gross addition of replacement chemistry. The solutions of this invention may be maintained at the proper level of chemical activity by the reduction of the spent (oxidized) metal ions to their development (reduced) state without the addition of supplemental chemistry, i.e., by only the contacting of the spent metal ion with a metal which will reduce the ion. In addition, the term regenerable means that if the system is allowed to stand in air when not operating, the operating electrochemical potential of the solution can be reached within one hour by contacting the solution with sufficient surface area of metal capable of reducing oxidized metal developer ions.

The developer solutions according to the practice of this invention may additionally contain those additives commonly associated with developer solutions. These additives include for example, hardeners (e.g., aldehydes, aluminum salts, etc.), swell control agents (e.g., sulfate), antifoggants, development accelerators, surfactants, viscosity control agents and various pH buffering agents. The developer solutions of this invention are also easily concentrated. Concentrates of these solutions are also air stable and may be readily diluted with water to form developer solutions. Silver complexing materials (containing or not containing silver) may also be added to these developing solutions to obtain physical and/or solvent development characteristics.

The developer solutions of the present invention may be used with any black and white silver halide photographic element, and in any black and white development step for any color silver halide photographic elements.

EXAMPLE I

Samples of a controlled sensitometrically exposed commercial high contrast (microfilm type) chlorobromide silver halide element were developed in a series of developer solutions of various age prepared from the same formulation. The samples were developed for 30 seconds at 90°F., washed, fixed, washed and dried. After processing the resultant densities of these processed films were measured with a MACBETH densitometer at identical exposure values:

| Formula I | Formula II |
|---|---|
| .1 molar $FeSO_4$ | Formula I with the addition of .10 molar ascorbic acid |
| .2 molar DTPA | |
| .03 molar KBr | |
| pH - 6.0 adjusted with NaOH | pH - 6.0 adjusted with sodium hydroxide |

The following table gives the results of this example.

TABLE I

| Formula | Age | Density |
|---|---|---|
| I | Fresh | 1.23 |
| I | 1 day | .45 |
| I | 2 days | .20 |
| II | Fresh | 1.34 |

TABLE I-continued

| Formula | Age | Density |
|---|---|---|
| II | 1 day | 1.36 |
| II | 2 days | 1.30 |
| II | 7 days | 1.10 |

As can be seen from Table I, the addition of ascorbic acid stabilizes the developer solution for several days. The developing capabilities of the solution are also enhanced by the addition. The basic developer solution is usable only when freshly prepared.

EXAMPLE II

Samples of a controlled sensitometrically exposed commercial high contrast (microfilm type) chlorobromide silver halide element were developed in a series of developer solutions as defined in Table II. The samples were developed for 30 seconds at 90°F., washed, fixed, washed and dried. The fixing solution used was the F-5 Fixer of Eastman Kodak, the formula as referenced in Photo Lab Index, Morgan & Morgan, Inc. Hastings on Hudson, N.Y., 1966, pp 6–91. After processing, the resultant densities of these processed films were measured with a MACBETH densitometer at identical exposure values.

TABLE II

| Formula No. | $FeSO_4$ | DTPA | AA | Phenidone | KBr | pH (NaOH) |
|---|---|---|---|---|---|---|
| 1 | 0.15M | 0.225M | — | — | 0.08M | 8.25 |
| 2 | — | — | 0.26M | — | 0.08M | 8.25 |
| 3 | — | — | — | 0.003M | 0.08M | 8.25 |
| 4 | 0.15M | 0.225M | 0.26M | — | 0.08M | 8.25 |
| 5 | 0.15M | 0.225M | — | 0.003M | 0.08M | 8.25 |
| 6 | — | — | 0.26M | 0.003M | 0.08M | 8.25 |
| 7 | 0.15M | 0.225M | 0.26M | 0.003M | 0.08M | 8.25 |

The superadditive and high contrast developing characteristics of the solutions of this invention can readily be seen from the data in Tables III and IV.

Example II was rerun with replacement of phenidone successively by hydroxylamine sulfate (HAS)
*CD-3 (4-amino-N-ethyl-N-(β-methanesulfoneamidoethyl)-m-toluidine
hydroquinone monosulfonate (HQS)
glycin (G)
cysteine hydrochloride (CH)

*CD-3 is actually a sulfate salt of this compound commmercially available from Eastman Kodak.

The following show that these materials also exhibit a superadditive effect. The date gives the results of these tests wherein the image density (density value minus the fog) is given. Ascorbic acid is represented in the tables by the abbreviation AA.

TABLE III

| Ingredient | Density | Contrast |
|---|---|---|
| Fe | 0.90 | 1.40 |
| Fe/AA | 1.10 | 1.73 |
| Fe/HAS | 0.96 | 1.48 |
| Fe/AA/HAS | 1.52 | 2.10 |
| HAS | 0.04 | — |
| CD-3 | 0.05 | — |
| Fe/CD-3 | 1.05 | 1.53 |
| Fe/AA/CD-3 | 1.63 | 2.25 |
| G | 0.04 | — |
| Fe/G | 0.94 | 1.44 |
| Fe/AA/Glycin | 1.58 | 2.14 |
| CH | 0.01 | — |
| Fe/CH | 0.92 | 1.41 |
| Fe/AA/CH | 1.60 | 2.08 |

TABLE III-continued

| Ingredient | Density | Contrast |
|---|---|---|
| HQS | 0.12 | — |
| Fe/HQS | 1.02 | 1.48 |
| Fe/AA/HQS | 1.58 | 2.15 |

TABLE IV

| Formula | Active Agents | Image Density | Contrast |
|---|---|---|---|
| 1 | Fe | 0.90 | 1.40 |
| 2 | AA | 0.02 | — |
| 3 | Phen. | 0.06 | — |
| 4 | Fe/AA | 1.10 | 1.73 |
| 5 | Fe/Phen. | 1.21 | 1.43 |
| 6 | AA/Phen. | 1.20 | 1.70 |
| 7 | Fe/AA/Phen. | 1.68 | 2.40 |

As can be seen from the above data, a superadditive effect exists between the ascorbic acid and the metal compounds and a ternary effect exists in the combination of iron, ascorbic acid and phenidone. Most importantly, only the ternary mixtures of this invention are capable of giving contrasts greater than 2.00.

One ancillary aspect of the practice of this invention is the ease of disposing of many solutions used according to this invention. In particular, when using iron, these aqueous solutions generally contain materials which can easily be disposed of without great harm to the environment.

As can be readily observed, none of the developer solutions in the examples contain a fixer or silver halide solvent, and the addition of an effective amount of fixer is not part of the present invention. The developer solutions of all examples in the practice of this invention are non-fixing developer solutions.

We claim:

1. A superadditive non-fixing developer solution comprising at least three developer materials, the solution comprising an iron chelating developer, a second developer selected from the group consisting of ascorbic acid, sugartype derivatives of ascorbic acid, and stereoisomers and diastereoisomers of ascorbic acid and its sugar-type derivatives, and a third developer selected from the group consisting of 1-phenyl-3-pyrazolidone, glycin, cysteine hydrochloride, hydroxylamine sulfate, 4-amino-N-ethyl-N-($\beta$-methanesulfoneamidoethyl)-m-toluidine, and hydroquinone monosulfonate.

2. The developer solution of claim 1 wherein the organic portion of the iron chelating developer is selected from ethylenediaminetetraacetic acid and diethylenetriaminepentaacetic acid.

3. The developer solution of claim 1 wherein the second developer is selected from ascorbic and isoascorbic acid.

4. The developer solution of claim 1 wherein the iron chelating developer is selected from ferrous ethylenediaminetetraacetic acid and ferrous diethylenetriaminepentaacetic acid, the second developer is selected from ascorbic and isoascorbic acid, and the third developer is selected from 1-phenyl-3-pyrazolidone and 4-amino-N-ethyl-N-($\beta$-methanesulfoneamidoethyl)-m-toluidine.

5. The developer of claim 1 wherein the concentration of the iron chelate developer is at least 0.05M, the concentration of the second developer is at least 0.05M and the concentration of the third developer is less than that of the second developer and at least 0.1mM.

* * * * *